United States Patent [19]

Van Meter

[11] Patent Number: 4,543,860

[45] Date of Patent: Oct. 1, 1985

[54] KEY RING ATTACHMENT

[76] Inventor: James A. Van Meter, 15357 Magnolia Blvd., Van Nuys, Calif. 91404

[21] Appl. No.: 553,194

[22] Filed: Nov. 18, 1983

Related U.S. Application Data

[63] Continuation-in-part of Ser. No. 427,670, Sep. 29, 1982, abandoned.

[51] Int. Cl.[4] ..... B25B 33/00

[52] U.S. Cl. ..... 81/488; 7/170; 70/456 R

[58] Field of Search ..... 70/456 R, 458; 7/166, 7/169, 170; 29/239, 270; 81/3 R

[56] References Cited

U.S. PATENT DOCUMENTS

| | | | |
|---|---|---|---|
| 1,162,955 | 12/1915 | Vaughan | 70/456 R |
| 3,263,804 | 8/1966 | Marenchin | 70/456 R |
| 3,955,449 | 5/1976 | Hofmeister et al. | 81/3 R |
| 4,325,273 | 4/1982 | Gibbons | 81/3 R |

*Primary Examiner*—Gary L. Smith
*Assistant Examiner*—Thomas J. Dubnicka
*Attorney, Agent, or Firm*—Jack C. Munro

[57] ABSTRACT

An attachment for a split ring type of key ring to facilitate separating of an end of the split ring from the remaining portion of the key ring permitting ease of insertion of a key on the key ring. The attachment comprises a sheet material member which is formed into an enlarged body section from which integrally extends a rounded protrusion. A necked down area connects between the protrusion and the body section. The outer end of the protrusion is sharpened. This sharpened outer end is to be inserted between abutting ring shaped members of the key ring and twisted ninety degrees with the key ring then being located within the necked down area which results in the end of the key ring being spaced from the remaining portion of the key ring facilitating locating of the end of the ring shaped member through the opening formed within the bow of a key.

2 Claims, 13 Drawing Figures

Fig.1.
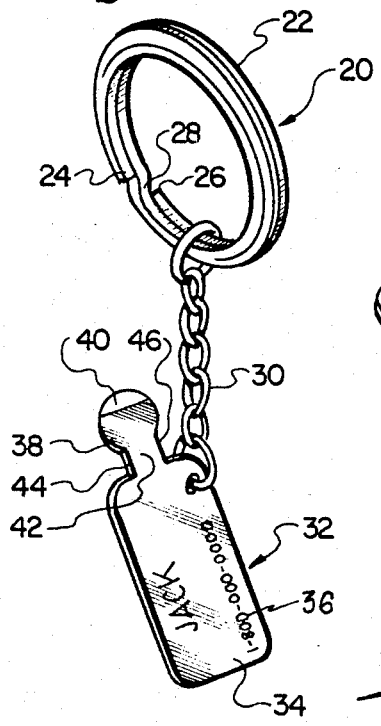
Fig.4.
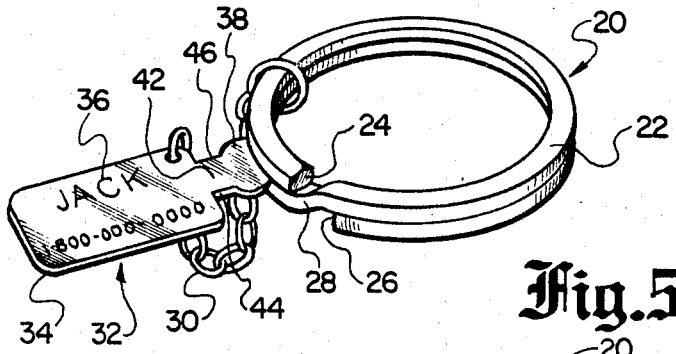
Fig.5.
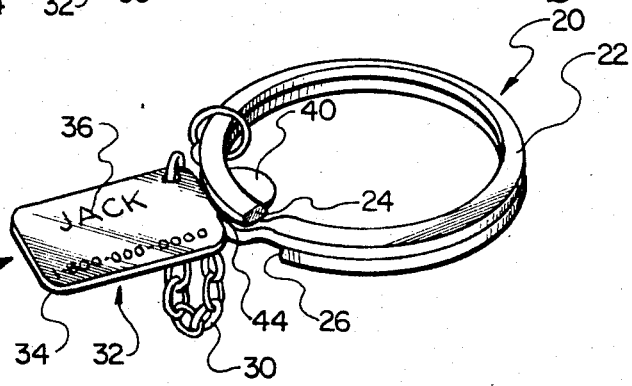
Fig.2.
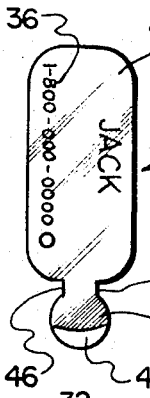
Fig.3.
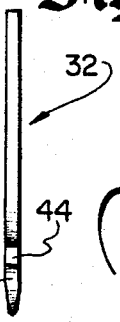
Fig.6.
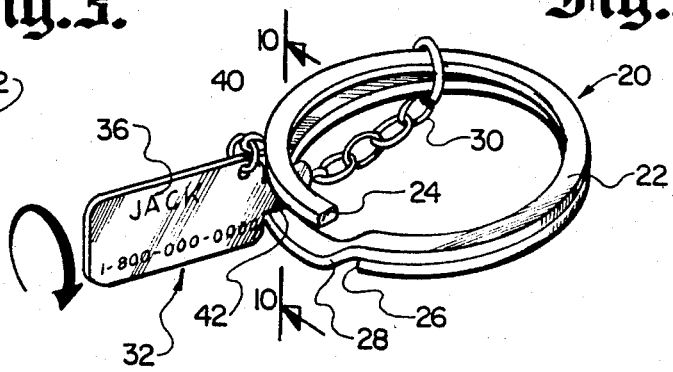
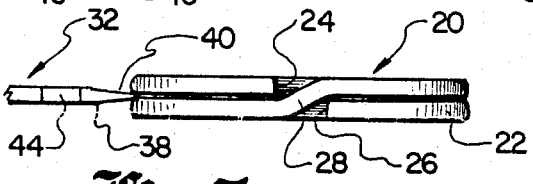
Fig.7.
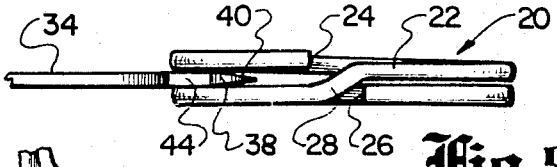
Fig.8.
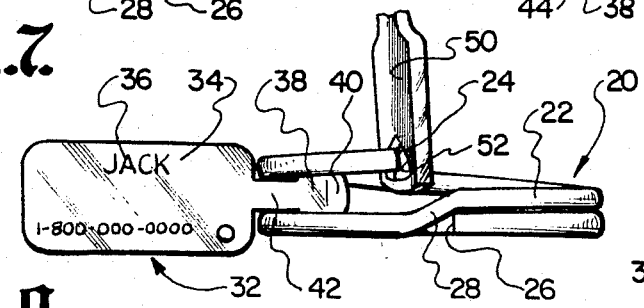
Fig.9.
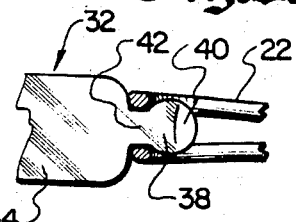
Fig.10.

KEY RING ATTACHMENT

REFERENCE TO PRIOR APPLICATION

The subject application is a continuation-in-part of U.S. patent application Ser. No. 427,670 filed Sept. 29, 1982, now abandoned, by the same title and by the same inventor.

BACKGROUND OF THE INVENTION

In extremely common use is a key ring which is constructed of a single thin strip of material which is wound in an overall circular pattern with the thin strip of material forming abutting, ring shaped members located in a helical arrangement. The length of the strip is selected to form substantially two complete revolutions.

The normal method of use is for the user to somehow separate an end from the remaining portion of the key ring which then is to be inserted through the opening which is normally found within the bow portion of a key. The key is then moved through a single three hundred and sixty degree revolution which then results in the entire cross section of the strip to be located within the opening formed within the bow of the key. Normally this type of key ring can be utilized to support a plurality of different keys. This split ring type of key ring securely holds the keys which totally prevents the accidental or unauthorized separation of a single key from the key ring. This split ring type of key ring is a popular and safe means of retaining keys for the home, car, shop, safes, deposit boxes, padlocks and the like.

However, it is normally difficult for an individual to separate an end of the member of the key ring from the remaining portion of the key ring so as to locate a key thereon and also remove a key. The normal way this is accomplished is by the individual using his or her fingernails in order to accomplish the desired separation. However, frequently the key ring will "snap" back together before one gets a chance to slip a key onto the member. Also, individuals, especially men, frequently do not have fingernails of enough length to be readily utilized to facilitate the desired separation of an end of the key ring. Further, women can easily damage their nails in operating a key ring.

SUMMARY OF THE INVENTION

The key ring attachment of this invention is constructed out of a rigid sheet material, such as aluminium or the like. The attachment includes a graspable enlarged body section which is integrally connected through a necked down section to a protrusion formed in a substantially rounded configuration. The width of the protrusion is substantially less than the width of the enlarged body section. Also, the width of the necked down section is less than the width of the protrusion. The necked down section has planar side edges which are located perpendicular to the front and rear surfaces of the enlarged body section. The outermost tip of the protrusion is beveled, or sharpened, so as to facilitate wedging between the abutting ring shaped members of the key ring. The attachment is then to be twisted ninety degrees which causes the normally abutting, but now separated, ring shaped members to nest within the necked down section. This spacing of one end of the abutting ring shaped members then permits the end to be readily inserted within the opening located within the bow of a key. Once the end has been so inserted, the attachment is again twisted ninety degrees and removed. The key is then moved longitudinally along the strip a total of three hundred and sixty degrees until the entire thickness of the abutting ring shaped members is conducted through the opening in the bow of the key. The enlarged body section is to be capable of having imprinted or inscribed thereon certain identifying indicia, such as a name, phone number and address, medical information or the like. Also, advertising could be inserted on one or both sides of the enlarged body section.

The primary objective of this invention is to construct an attachment which facilitates the locating of removing a key on a split ring type of key ring.

Another objective of this invention is to construct an attachment which is to be utilized in conjunction with a key ring and can be readily connected thereto by a connecting chain and which is small in size to therefore occupy a small amount of space and does not interfere with the normal operating and carrying of the key ring.

Another objective of the invention is to utilize an attachment which can be operated to accomplish other objectives, such as initial opening movement of a beverage container opening tab or any other device in which it is difficult to effect this initial opening movement by one's fingernails.

BRIEF DESCRIPTION OF THE DRAWINGS

FIG. 1 is an isometric view of a typical key ring to which has been connected the attachment of the present invention;

FIG. 2 is a front plan view of the attachment of the present invention;

FIG. 3 is a right side view of the attachment of the present invention;

FIG. 4 is an isometric view showing initial operation of the attachment of the present invention in conjunction with a key ring;

FIG. 5 is a view similar to FIG. 4, but showing the attachment in the fully inserted position in conjunction with the key ring;

FIG. 6 is an isometric view similar to FIG. 5 but showing the attachment in a ninety degree pivoted position with respect to the position shown in FIG. 5;

FIG. 7 is a front elevational view of the structure of FIG. 4;

FIG. 8 is a front elevational view of the structure of FIG. 5;

FIG. 9 is a front elevational view of the attachment and key ring shown in FIG. 6;

FIG. 10 is a cross-sectional view taken along line 10—10 of FIG. 6;

DETAILED DESCRIPTION OF THE SHOWN EMBODIMENT

Figure 11:
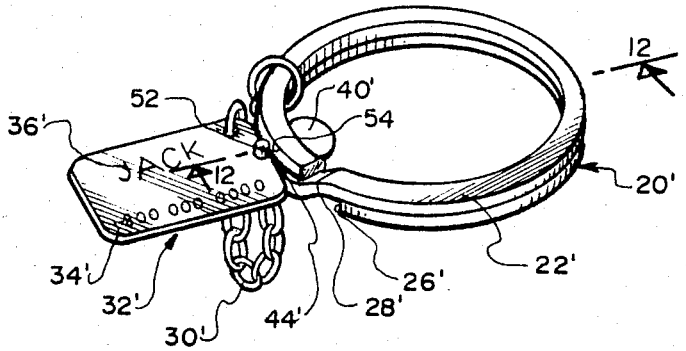
FIG. 11 is an isometric view of a modified form of the attachment of the present invention showing the attachment in the fully inserted position in conjunction with the key ring.

Referring particularly to the drawings, there is shown a conventional key ring 20 which is known generally as a split ring, which is composed of a single thin strip of material, usually metal, which is wound upon itself in a helical manner forming a plurality (normally two in number) of abutting ring shaped members. The strip 22 terminates at ends 24 and 26. The ends 24 and 26 terminate at an offset section 28 formed at approximately the mid point of the length of the strip 22. It is to be noted that the material of construction of the strip 22 is such that if either of the ends 24 and 26 is deflected outwardly so as to be spaced from the remaining portion of the key ring 20, that upon release of the force holding the end spaced therefrom, the end will inherently return to the position abutting the remaining portion of the key ring 20. The construction of the key ring 20 is deemed to be conventional and forms no specific part of this invention.

Connected to the key ring 20, by means of a connecting chain assembly 30, or other similar connection means, is an attachment 32. The attachment 32 is formed of thin sheet material such as aluminum or other similar material. It is understood that the attachment 32 could be constructed of plastic.

The attachment 32 comprises an enlarged body section 34 which is substantially rectangular in configuration. The enlarged body section 34 can include certain identifying indicia 36, if such is desired. The identifying indicia can be imprinted, embossed or otherwise inscribed on the enlarged body section 34.

Integrally attached to the enlarged body section 34 is a protrusion 38. The protrusion 38 is basically circular in configuration and is of a width which is somewhat smaller than the width of the enlarged body section 34. The outer end of the protrusion 38 is beveled to form a sharpened, or pointed, section 40. The sharpening of the edge 40 is not sufficient to cause injury to an individual or damage to personal possessions. The inner end of the protrusion 38 forms a shoulder which helps to retain the attachment 32 in operating position by coming in physical contact with the inner surface of the strip 22 thereby preventing accidental dislodgement of the attachment 32 from the key ring 20. Therefore, it can be left unattended freeing the operator's hands.

The protrusion 38 is connected to the enlarged body section 34 by means of a necked down section 42. The necked down section 42 is of a width which is somewhat less than the width of the protrusion 38. The necked down section 42 has side edges 44 and 46. The plane of the edges 44 and 46 are parallel to each other and are also located substantially perpendicular to the plane of the front and rear surfaces of the enlarged body section 34.

In operating the attachment 32 of the present invention, the operator grasps the enlarged body section 34 and positions the sharpened edge 40 of the protrusion 38 in contact with the key ring 20, such as shown in FIG. 4 of the drawing. The protrusion 38 is located a short distance (approximately one half inch) from the end 24. It is also to be understood that the attachment 32 could equally be used in conjunction with the end 26.

The operator then proceeds to exert a force wedging the protrusion 38 between the abutting ring shaped members of the key ring 22 which causes the end 24 to be slightly spaced from its abutting ring shaped member. At this particular time, the abutting ring shaped members are located directly adjacent the necked down section 42.

The operator then twists the attachment 32 approximately ninety degrees. The surfaces of the abutting ring shaped members which form the key ring 22 will then rest on the planar edges 44 and 46 and the attachment 32 will remain in the position shown in FIG. 6. The operator is then free to take a key 50 and conduct the end 24 through the opening 52 formed within the bow of the key. This means that beginning of connecting of the key to the key ring 20 has been accomplished. The operator then retwists the attachment 32 ninety degrees and withdraws such from connection with the key ring 20. The operator then continues to move the key 50 through a complete circle (three hundred and sixty degrees) along the key ring 20. At this particular time, the key 50 is fully installed on the key ring 20.

Figure 12:
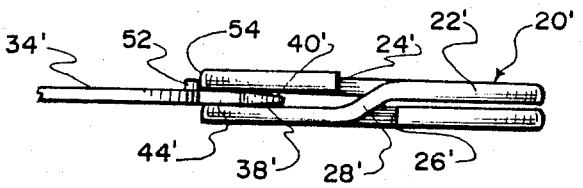
FIG. 12 is a cross-sectional view taken along line 12—12 of FIG. 11.
Figure 13:
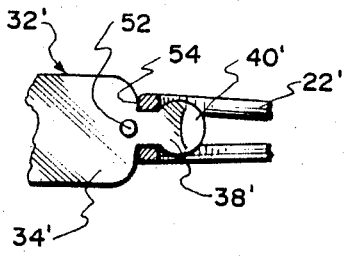
FIG. 13 is a cross-sectional view showing the attachment in a ninety degree pivoted position with respect to the position shown in FIG. 12.

Referring particularly to FIGS. 11 to 13 of the drawings, there is shown a modified form of the attachment of this invention. Like numerals have been utilized to refer to like parts in respect to FIGS. 1 and 10. The key ring 20' is identical to key ring 20 which is shown formed in a single thin strip 22' of metallic material. The strip 22' terminates at ends 24' and 26'. The ends 24' and 26' terminate at an offset section 28' formed at approximately the mid-point the length of the strip 22'.

Connected to the key ring 20' by means of a connecting chain assembly 30', is the attachment 32'. The attachment 32' is formed of a thin sheet material such as aluminum or other similar metal. It is to be understood that the attachment 32' could be constructed of plastic.

The attachment 32' comprises of a large body section 34' which is substantially rectangular in configuration. The enlarged body section 34' can include certain identifying indicia 36' if such is desired. The identifying indicia can be imprinted, embossed or otherwise inscribed on the enlarged body section 34'.

Attached to the enlarged body section 34' is a protrusion 38'. The protrusion 38' is basically circular in configuration and is of a width somewhat smaller than the width of the enlarged body section 34'. The outer end of the protrusion 38' is beveled to form a sharpened or pointed section 40'.

The protrusion 38' is connected to the enlarged body section 34' by means of a necked-down section, which is defined by side edges 44'. Adjacent the necked-down section there is mounted on the enlarged body section a stop-pin 52. The advantage of the attachment 32', versus the attachment 32 is that, as the attachment is inserted into position in conjunction with the key ring 20', the stop-pin 52 will come into contact with area 54 of the key ring 20' aligning the strip 22' in conjunction with the necked-down section defined by side edges 44'. In other words, the stop-pin 52 functions to prevent the enlarged section 32' from being inserted too far in conjunction with the key ring 20'. If the operator has the stop-pin 52 in contact with the key ring 20', the operator only need to twist the attachment 32' ninety degrees and the strip 22' will be positioned directly in contact with the side edges 44'.

What is claimed is:

1. In combination with a split key ring adapted to support a plurality of different keys for locks, said split key ring being constructed of a rigid thin strip of material which is helically wound on itself forming a plurality of abutting ring shaped members, said strip terminating in ends, the improvement comprising:

a sheet material attachment to facilitate the spreading apart of a portion of said abutting ring shaped members so as to permit ease of insertion of a key on said strip, said attachment comprising an enlarged body section which is readily graspable by a human being and a protrusion integrally attached to said enlarged body section and extending therefrom, said protrusion to be wedged between said abutting ring shaped members adjacent a said end thereby spacing said end from the directly adjacent ring shaped member facilitating locating of a key on said strip, said protrusion having an outermost edge being sharpened to facilitate wedging between said abutting ring shaped members;

a necked down area between said protrusion and said enlarged body section, said necked down area being of a width less than both said protrusion and said enlarged body section, said necked down area having side walls, said side walls being planar, the lateral cross sectional configuration of said necked down area being of a rectangular configuration; and the portion of said protrusion located directly adjacent said necked down area being smoothly contoured so as to function as a guide to properly locate said strip within said necked-down area, said protrusion to be pivoted ninety degrees to an operating position when fully wedged between said abutting ring shaped members thereby further spacing of said end of said strip from the directly adjacent said ring shaped member with said attachment on said operating position said inner edges preventing accidental dislodgement of said attachment from said key ring.

2. The combination as defined in claim 1 including:

a stop-pin mounted on said enlarged body section to limit the extent of movement of said attachment in conjunction with said split key ring prior to operating of said attachment to spread apart said abutting ring shaped members, said stop-pin being mounted directly adjacent said necked-down area.

* * * * *